US006026593A

United States Patent [19]

Harmon-Weiss et al.

[11] Patent Number: 6,026,593

[45] Date of Patent: Feb. 22, 2000

[54] SHOE SOLE CUSHION

[75] Inventors: Edith Michele Harmon-Weiss, Swampscott, Mass.; Sean Michael McDowell, Beaverton, Oreg.

[73] Assignee: New Balance Athletic Shoe, Inc., Boston, Mass.

[21] Appl. No.: 08/985,999

[22] Filed: Dec. 5, 1997

[51] Int. Cl.[7] ..... A43B 13/20

[52] U.S. Cl. ..... 36/28; 36/35 R; 36/37

[58] Field of Search ..... 36/28, 29, 37, 36/35 B, 27, 35 R

[56] References Cited

U.S. PATENT DOCUMENTS

| | | | |
|---|---|---|---|
| 541,814 | 6/1895 | King . | |
| 900,867 | 10/1908 | Miller . | |
| 949,754 | 2/1910 | Busky . | |
| 1,011,460 | 12/1911 | Maddocks . | |
| 1,241,142 | 9/1917 | O'Hara . | |
| 1,382,831 | 6/1921 | Hilker . | |
| 2,028,060 | 1/1936 | Gilbert | 47/23 |
| 2,080,469 | 5/1937 | Gilbert | 36/29 |
| 2,106,788 | 2/1938 | Borman | 36/28 |
| 2,122,108 | 6/1938 | Modlin | 36/36 |
| 2,372,218 | 3/1945 | Manson et al. | 5/348 |
| 2,405,498 | 8/1946 | Gregg | 36/32 |
| 2,657,385 | 11/1953 | Cushman et al. | 2/24 |
| 2,677,904 | 5/1954 | Reed | 36/29 |
| 2,677,906 | 5/1954 | Reed | 36/71 |
| 2,863,230 | 12/1958 | Cortina | 36/29 |
| 3,041,746 | 7/1962 | Rakus | 36/36 |
| 3,429,545 | 2/1969 | Michel . | |
| 3,765,422 | 10/1973 | Smith | 36/28 |
| 3,965,486 | 6/1976 | Lightbody | 2/24 |
| 3,991,420 | 11/1976 | Savarino | 2/2 |
| 4,054,960 | 10/1977 | Pettit et al. | 5/357 |
| 4,063,371 | 12/1977 | Batra | 36/3 |
| 4,115,885 | 9/1978 | Davis | 5/349 |
| 4,137,653 | 2/1979 | Famolare, Jr. | 36/3 B |
| 4,183,156 | 1/1980 | Rudy | 36/44 |
| 4,217,705 | 8/1980 | Donzis | 36/29 |
| 4,224,749 | 9/1980 | Diaz-cano | 36/35 R |
| 4,229,889 | 10/1980 | Petrosky | 36/28 |
| 4,267,648 | 5/1981 | Weisz | 36/28 |
| 4,319,412 | 3/1982 | Muller et al. | 36/29 |
| 4,342,158 | 8/1982 | McMahon et al. | 36/35 |

(List continued on next page.)

FOREIGN PATENT DOCUMENTS

| | | |
|---|---|---|
| 584489 | 2/1925 | France . |
| 979132 | 4/1951 | France . |
| 203631 | 10/1908 | Germany . |
| 2800359 | 12/1979 | Germany . |
| 3542960 | 6/1986 | Germany . |
| 777630 | 6/1957 | United Kingdom . |
| 2032761 | 5/1980 | United Kingdom . |
| 1603646 | 11/1981 | United Kingdom . |
| 2225212 A | 5/1990 | United Kingdom . |
| 92/04944 | 4/1992 | WIPO . |

*Primary Examiner*—M. D. Patterson
*Attorney, Agent, or Firm*—Pennie & Edmonds LLP

[57] ABSTRACT

A cushion for use in a shoe sole with resilient, arcuate, load-bearing first and second and central walls. The first and second walls are tubular and are configured for supporting and cushioning edges of a foot. They respectively form first and second tubular portions of the cushion extending generally along a lateral and medial sides of a foot shape. The central wall is configured for supporting and cushioning a laterally central part of the foot and forms a hollow central portion. The central portion is disposed between and joined with the first and second tubular portions. The central wall and first tubular wall are coupled at a coupled section such that vertical deformation of one of the central and first walls is transmitted to the other. The coupling portion has vertically spaced walls that join vertically spaced sections of the central and tubular walls. A recessed portion of the cushion isolates vertical deformation of adjacent sections of the central and tubular walls. Ribs extend across the walls to increase their vertical compressive stiffness. The preferred cushion is shaped for cushioning a heel, with the coupled portion positioned off-center, towards the rear of the heel.

28 Claims, 5 Drawing Sheets

U.S. PATENT DOCUMENTS

| | | | |
|---|---|---|---|
| 4,458,429 | 7/1984 | Schmid | 36/3 |
| 4,462,171 | 7/1984 | Whispell | 36/3 |
| 4,535,553 | 8/1985 | Derderian et al. | 36/28 |
| 4,559,724 | 12/1985 | Norton | 36/129 |
| 4,594,799 | 6/1986 | Lin | 36/114 |
| 4,610,099 | 9/1986 | Signori | 36/3 |
| 4,614,000 | 9/1986 | Mayer | 5/484 |
| 4,629,433 | 12/1986 | Magid | 441/40 |
| 4,670,995 | 6/1987 | Huang | 36/29 |
| 4,680,875 | 7/1987 | Danieli | 36/31 |
| 4,680,876 | 7/1987 | Peng | 36/35 B |
| 4,741,114 | 5/1988 | Stubblefield | 36/32 R |
| 4,753,021 | 6/1988 | Cohen | 36/3 B |
| 4,768,295 | 9/1988 | Ito | 36/28 |
| 4,774,774 | 10/1988 | Allen, Jr. | 36/28 |
| 4,774,776 | 10/1988 | Gulli | 36/29 |
| 4,815,221 | 3/1989 | Diaz | 36/27 |
| 4,845,861 | 7/1989 | Moumdjian | 36/29 |
| 4,878,300 | 11/1989 | Bogaty | 36/35 |
| 4,887,367 | 12/1989 | Mackness et al. | 36/28 |
| 4,912,861 | 4/1990 | Huang | 36/29 |
| 4,918,838 | 4/1990 | Chang | 36/28 |
| 4,918,841 | 4/1990 | Turner et al. | 36/114 |
| 4,936,029 | 6/1990 | Rudy | 36/29 |
| 4,972,611 | 11/1990 | Swartz et al. | 36/28 |
| 4,999,931 | 3/1991 | Vermeulen | 36/29 |
| 5,005,300 | 4/1991 | Diaz et al. | 36/114 |
| 5,014,449 | 5/1991 | Richard et al. | 36/114 |
| 5,067,255 | 11/1991 | Hutcheson | 36/43 |
| 5,092,060 | 3/1992 | Frachey et al. | 36/29 |
| 5,131,174 | 7/1992 | Drew et al. | 36/29 |
| 5,174,049 | 12/1992 | Flemming | 36/28 |
| 5,199,191 | 4/1993 | Moumdjian | 36/28 |
| 5,212,878 | 5/1993 | Burke et al. | 36/27 |
| 5,224,278 | 7/1993 | Jeon | 36/29 |
| 5,245,766 | 9/1993 | Warren | 36/29 |
| 5,253,435 | 10/1993 | Auger et al. | 36/88 |
| 5,255,451 | 10/1993 | Tong et al. | 36/30 |
| 5,257,470 | 11/1993 | Auger et al. | 36/88 |
| 5,343,639 | 9/1994 | Kilgore et al. | 36/29 |
| 5,353,459 | 10/1994 | Potter et al. | 12/146 R |
| 5,353,523 | 10/1994 | Kilgore et al. | 36/29 |
| 5,353,526 | 10/1994 | Foley et al. | 36/92 |
| 5,367,792 | 11/1994 | Richard et al. | 36/114 |
| 5,396,675 | 3/1995 | Vincent et al. | 12/142 P |
| 5,406,719 | 4/1995 | Potter | 36/28 |
| 5,416,988 | 5/1995 | Potter et al. | 36/89 |
| 5,425,184 | 6/1995 | Lyden et al. | 36/29 |
| 5,572,804 | 11/1996 | Skaja et al. | 36/29 |
| 5,575,088 | 11/1996 | Allen et al. | 36/28 |

SHOE SOLE CUSHION

FIELD OF THE INVENTION

The present invention relates to a cushion for placement in a shoe sole for cushioning and supporting a foot. More particularly, the invention relates to a cushion that has a central hollow portion disposed between and joined with vertically stiffer tubular portions which are located around edges of a foot shape.

BACKGROUND OF THE INVENTION

Resilient athletic shoe soles have been made with a variety of resilient cushioning elements for storing and absorbing impact energy imposed on a wearer's feet. Known shoe soles include fluid bladders that either contain pressurized air or a viscous liquid or gel to absorb shock and store energy.

U.S. Pat. No. 5,406,719, for instance, discloses a bladder that is pressurized with a gas. The bladder includes a heel support with various gas chambers. Gas chambers are located around the perimeter of the heel support, and additional chambers are located centrally in the heel support. The gas confined in the chambers provides cushioning for a foot as gas pressure increases in response to loads applied on the chambers. The patent shows the central chamber communicated with a lateral chamber so that internal gas pressure is equalized between the chambers.

U.S. Pat. No. 5,353,459 also shows a bladder for cushioning a heel. The bladder has a horse-shoe shaped chamber that extends about the periphery of the bladder, from the medial side to the lateral side around the rear of the bladder. Within the horse-shoe shape is a central chamber. As in the '719 patent disclosure, this stiffness of the chambers is controlled by altering the gas pressure therein.

U.S. Pat. No. 4,183,156 discloses an insole shaped insert with interconnected chambers that form pneumatic springs. Two of these chambers are tubular and extend around the sides and back of the heel of the insole. Two additional tubular chambers are disposed between the chambers that extend around the heel sides.

Cushioning bladders that employ a gas or other fluid to cushion shock to a foot suffer from a number of disadvantages. These bladders can usually leak over time, and gas units are especially prone to loss of pressure as the bladder ages. Moreover, the bladders are subject to punctures caused by sharp objects. Once the bladders are punctured, their contents are free to escape, and the bladders cease to effectively cushion shocks. Furthermore, fluid filled bladders also tend to pop and/or compress over time. Most perform significantly differently at different temperatures as the pressure or viscosity of the contained fluids varies. Also, because the fluid within the bladders tends to equalize the pressure within chambers of the bladders, compression of one part of a chamber may merely force the fluid to another part of the chamber decreasing control over localized deformation, and thus cushioning, of the bladder.

Other known soles employ resilient structures that rely on walls of the structure rather that on a fluid contained therein to cushion impact on a wearer's foot. U.S. Pat. No. 5,255,451, for example, teaches a shoe sole with an insert formed from a plurality of undulations. U.S. Pat. No. 4,774,774 shows a midsole formed of a honeycomb structure. Also, U.S. Pat. No. 4,342,158 teaches a sole with a coned disk spring member disposed in the sole heel.

These prior art cushions in which the walls carry cushioning loads are generally located in relatively large areas of portions of a foot. The prior teachings fail to take advantages certain shapes that are provided by fluid filled bladders.

Thus, a foot sole cushion is needed which overcomes the disadvantages of prior art devices. For example, the use of the walls of the cushion, rather that its contents, to carry most of the impact loads imposed upon it, and the precise control of the stiffnesses of various portions of the cushion would be desirable.

SUMMARY OF THE INVENTION

The invention provides a cushion for use in a shoe sole. The cushion includes resilient load-bearing first and second hollow tubular walls that are shaped to support and cushioning edges of the shoe wearer's foot. The tubular walls form first and second tubular portions, one of which extends generally along a lateral side of the wearer's foot, and the other of which extends generally along a medial side of the wearer's foot.

The cushion also has a resilient load-bearing central wall configured to support and cushion a widthwise central part of the foot disposed generally centrally across the width of the foot shape. The central wall forms a hollow central portion and is located between and joined with the tubular portions.

The preferred embodiment of the cushion provides a coupled portion in which the central wall and first tubular wall are coupled such that vertical deformation of one of the central and first walls is transmitted to the other. In the coupling portion, vertically spaced elevated sections of the central and first walls are so coupled by vertically spaced coupling walls. At least one of the coupling walls joins together elevated walls that are adjacent each other. Thus, vertical deformation is transmitted through the coupling walls between the coupled walls of the central portion and first tubular portion.

The coupling portion of the preferred embodiment of the cushion is placed in a heel strike area of the wearer's foot, which receives the first and concentrated loads generated during a running step. Where the cushion is for the wearer's heel, the coupling portion is disposed off-center, laterally with respect to a longitudinal centerline that extends through the heel section of the sole. The coupling portion is also preferably configured and dimensioned for placement near the strike path of the wearer's foot, which receives the largest loads generated during the running step.

Where the central and tubular walls are not coupled, the preferred embodiment has a recessed portion that joins the central portion and first tubular portion. Because this portion is recessed and preferably lacks walls that are vertically spaced to any significant extent, vertical deformation is substantially isolated between sections of the central wall and first tubular wall which are disposed adjacent the recessed portion.

The invention is particularly suited for use in the heel portion of a shoe sole. In this arrangement, the first tubular portion extends along lateral and rear edges of the heel portion to support lateral and rear edges of the wearer's heel. The two tubular portions are joined at a rear section of the heel, together forming a single tubular portion that extends substantially continuously along the entire contour of the heel shape of the sole. The central portion of the cushion is preferably joined to the tubular portions at a rear part of the central portion, with the central and tubular walls defining a lower surface that slopes upwards from the horizontal.

The central and tubular walls are preferably arcuate. As a result, the central and tubular portions have oval cross-sections along a plane that extends widthwise and vertically. In the preferred embodiment, the central and tubular portions have a substantially similar vertical height. The medial to lateral width of the central portion is greater than at least one of the medial to lateral widths of the tubular portions. Preferably, an aspect ratio of width to height of the central portion reaches a maximum of between about 2 and 4, and an aspect ratio of the first tubular portion is between about 0.75 and 1.5.

To strengthen the walls of the cushion, at least one of the tubular and central walls preferably has ribs extending widthwise thereacross. Where the walls have substantially uniform thicknesses, grooves are defined on a side of the walls opposite the ribs.

The cushion is preferably of unitary construction from a single piece of molded plastic material, with the tubular portions vertically stiffer than the central portion. The stiffer tubular portions stabilize the wearer's foot towards the central portion due to their shape.

As the support of the cushion if provided by the load-bearing central and tubular walls themselves, any air trapped within the cushion is preferably not pressurized and is at atmospheric pressure. This reduces problems associated with fluid or gas pressurized bladders of the prior art.

The preferred placement of the cushion within a sole of a shoe is as a midsole, with an outsole mounted below the cushion to contact the ground. The cushion itself, however, may be employed as an outsole in some embodiments.

DETAILED DESCRIPTION OF THE PREFERRED EMBODIMENTS

Figure 1:
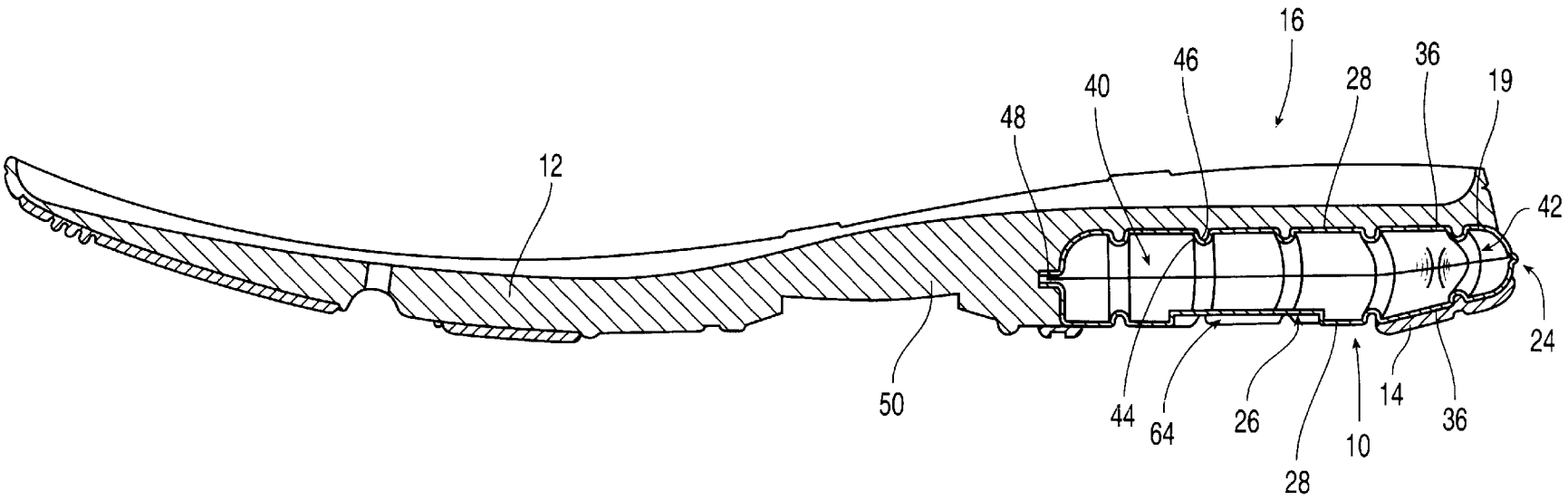
FIG. 1 is a cross-sectional lateral view of a portion of a left shoe sole with a cushion according to the invention.

FIG. 1 shows a sole employing the preferred embodiment of a cushion 10 of the invention in a heel portion 16 of the sole. The sole includes a midsole 12 and an outsole 14. In this embodiment, the cushion 10 is part of the midsole 12, but is partially exposed on its lower side and may contact the ground, thus serving also as an outsole.

Figure 2:
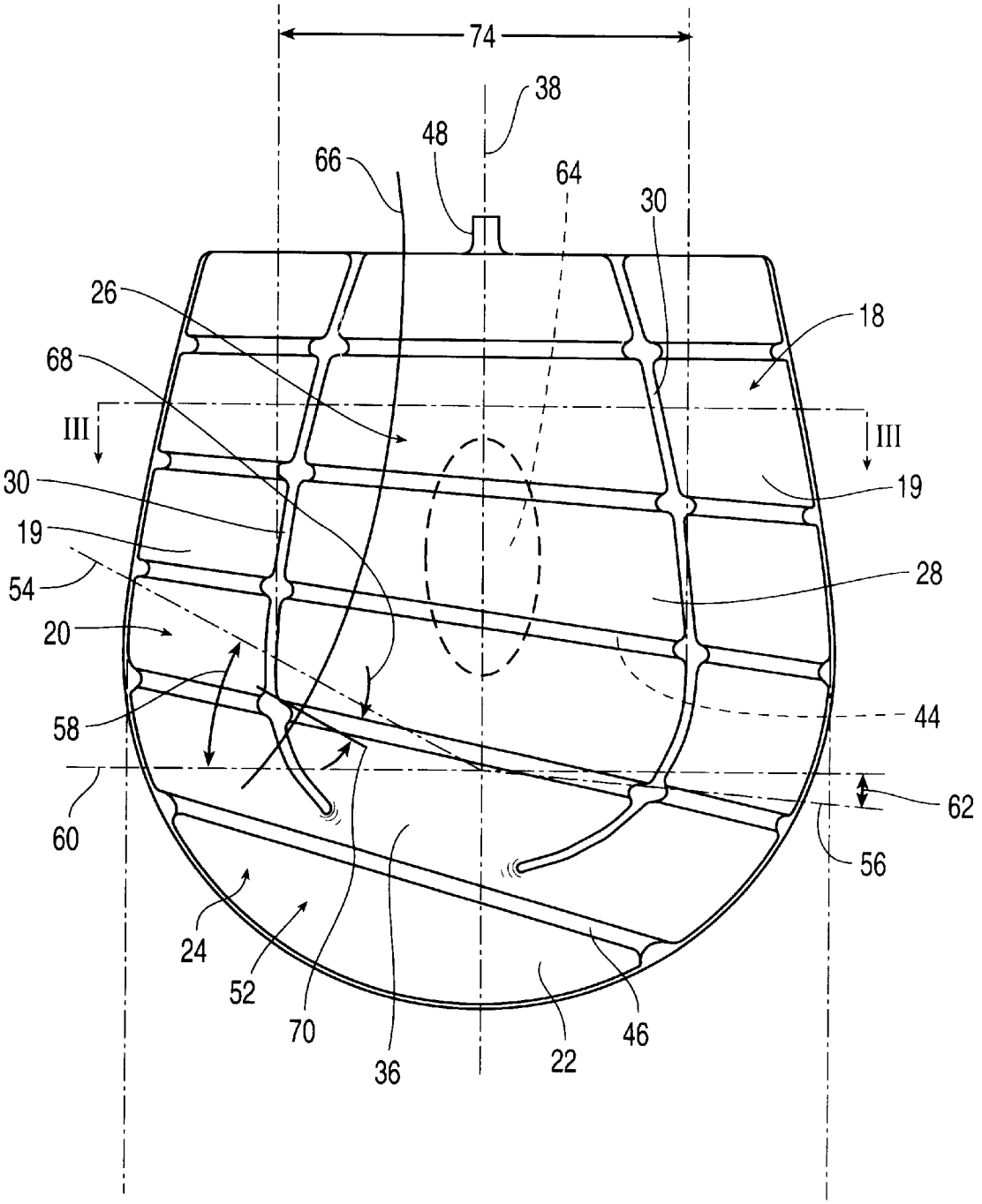
FIG. 2 is a top view of the cushion.

Referring to FIG. 2, the cushion has an outer tubular portion 24 that includes a medial tubular portion 18 and a lateral tubular portion 20, which are formed by resilient load-bearing tubular walls 19. Tubular portions 18 and 20 extend along medial and lateral edges of the foot shape of the sole. In the preferred embodiment, the tubular portions 18 and 20 extend generally along the medial and lateral edges of the heel shape part of the foot shape. The tubular portions 18 and 20 also extend along the rear edge 22 of the heel shape, together preferably forming the single, substantially continuous, outer tubular-portion 24. The resulting tubular portion 24 extends un a U-shape substantially continuously along the contour of the heel shape. The walls 19 forming the outer portion 24 are configured and dimensioned for supporting edges of a foot and cushioning impact produced thereon, for example, by walking, running, or jumping.

A hollow central portion 26 is disposed between and joined with the medial and lateral portions 18 and 29. The central portion 26 if formed by a resilient load-bearing central wall 28. Preferably, the central 28 wall is joined to the tubular walls 19 along the entire extent at which the central portion 26 lies adjacent the tubular portion 24, including on the medial, lateral, and rear sides of the central portion 26. The central wall 28 is configured and dimensioned for supporting and cushioning a central portion of the foot, in this case of the heel.

The walls 28 and 19 themselves carry most of the loads imposed on the cushion 10. Hence, the air or other material contained within the cushion 10 is preferably not relied upon to support or cushion a foot. The walls 28 and 19 of the cushion provide a significant portion of the support by the cushion. Although air or other material may be trapped within the cushion, most preferably, the material in the trapped material does not provide significant support or cushioning.

The cushion 10 also has recessed portions 30 that extend between the central and tubular portions 26 and 24. The recessed portions 30 join the central and tubular portions 26 and 24 while isolating vertical deformation between the sections of the tubular walls 19 and the central wall 28 that lie adjacent the recessed portions 30.

Figure 3:
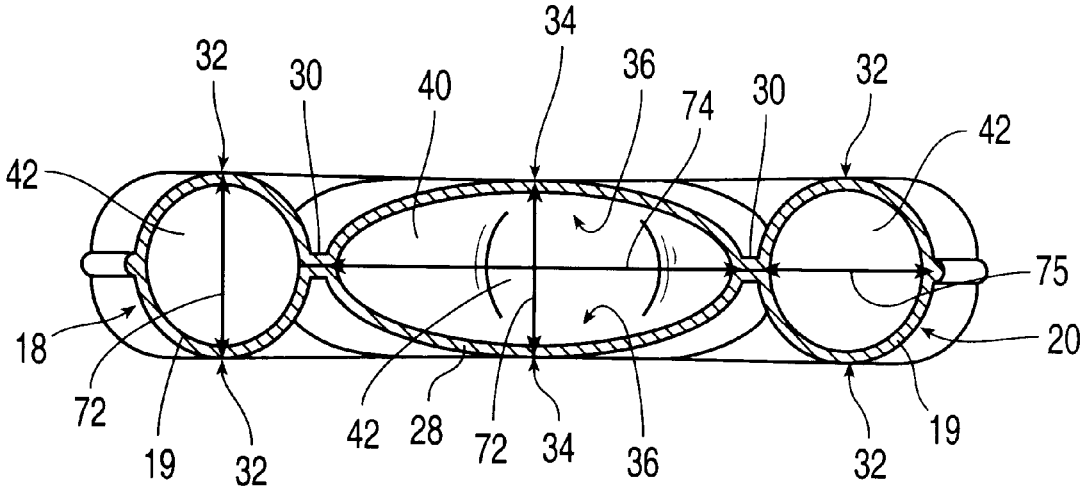
FIG. 3 is a cross-sectional front view of the cushion along plane III—III of FIG. 2.

As seen in FIG. 3, the tubular walls 19 have vertically spaced elevated sections 32, and the central wall has vertically spaced elevated sections 34. The term elevated in this context includes upper and lower portions of the walls and does not refer solely to the top side of the cushion. Because the elevated portions 32 of the tubular walls 19 are isolated from the elevated portions 34 of the central wall 28, substantially no vertical compression is transmitted therebetween across the recessed portions 30.

Referring again to FIG. 2, the cushion 10 also includes a coupling portion 36 with at least one wall elevated from the level of the recessed portions 30, preferably separating recessed portions 30 of the cushion 10. The coupling wall 36 connects the central elevated sections 34 to the tubular elevated sections 32. This connection couples the adjacent elevated sections 32 and 34 such that vertical deformation is transmitted between the tubular walls 19 and the central wall 28.

The coupling portion 36 permits energy to be stored and absorbed by both the central walls 28 and the tubular walls 18 and 20 when the cushion 10 is impacted in locations on either the central or tubular portions 26, 18, or 20 that are near the coupling portion 36. The location of the coupling portion 36 is preferably selected to provide the improved cushioning near common areas of impact on the shoe sole. When the cushion is disposed in the heel of a sole, the coupling portion 36 is preferably disposed at the rear of the heel, generally aligned with a heel strike area 52, which is known in the art, as explained below.

Figure 4:
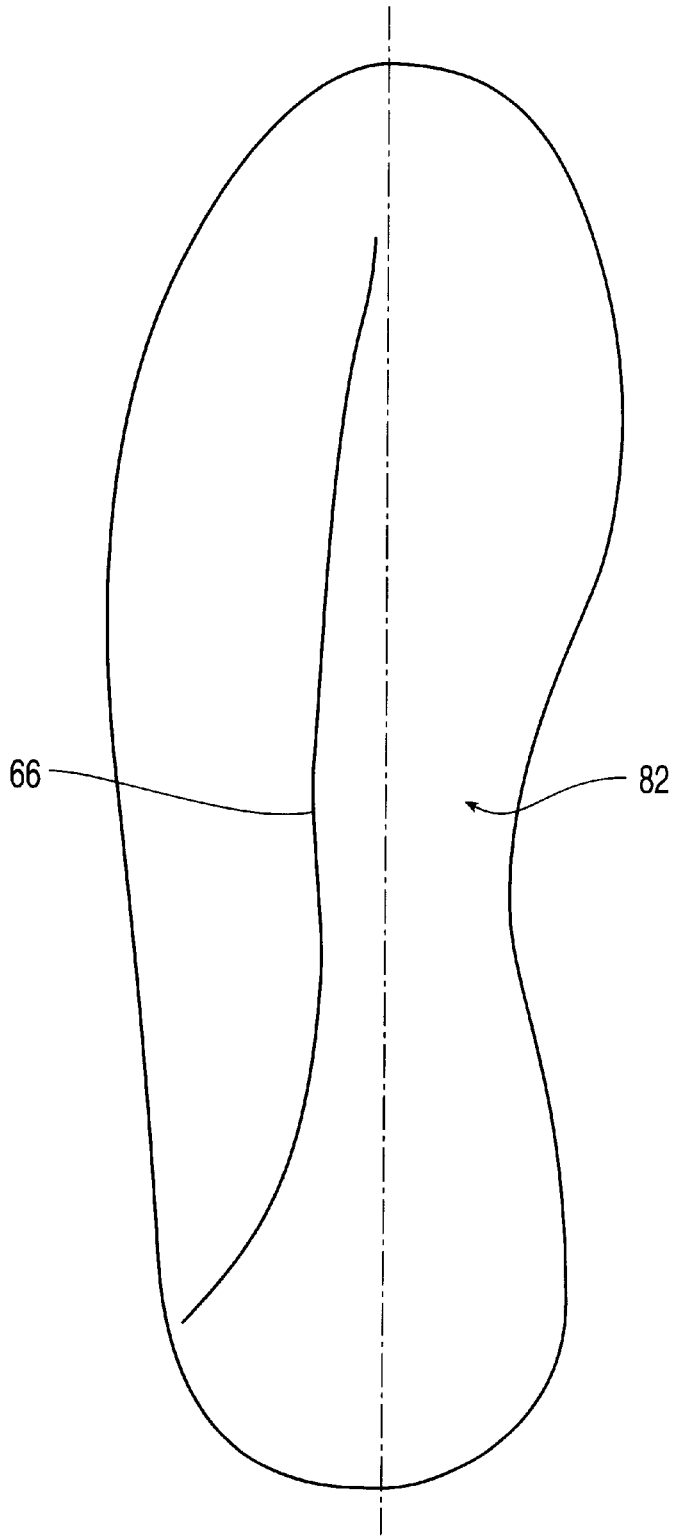
FIG. 4 is a top view of a running strike-path on a foot shape.

It is well known in the art that during a step, particularly while a wearer is running, the wearer's foot strikes the sole generally along a strike path 66, shown in FIG. 4. The strike path 66 along the sole is S-shaped and extends from the heel to the fore foot portion of the foot shape 82 of the sole. This path 66 receives first and largest loads from impact on the sole. The heel strike area 52 is the area in the heel of the sole that is known to receive the first and most intense impact by a wearer's foot.

The cushion is shown in FIG. 2 disposed in the sole such that the heel strike area 52 is disposed in the region defined behind lines 54 and 56. In the preferred cushion 10 sized for a men's size 9.5 shoe, lines 54 and 56 intersect centerline 38 of the cushion 10 at about 23 to 31 mm from the rear of the cushion 10. This distance varies according to shoe size. Line 54 extends laterally at an angle 58 of about 25° forward from a horizontal line 60 normal to the centerline 38. Preferably angle 58 is generally 12° and 36°, such as between about 20° and 30°, and most preferably, angle 58 is about 25.5°. Line 56 extends medially at an angle 62 of about 5° behind line 60. Preferably angle 62 is between about 0° and 25°, such as between 1° and 10°, and most preferably, angle 62 is about 4.5°. Thus, the coupling portion 36, being disposed generally centrally with respect to the heel strike area 52, is displaced laterally from the centerline 38.

Because central and tubular portions 26 and 24 are hollow, the central portion 26 defines a central interior chamber 40, and the tubular portion 24 defines a tubular interior chamber 42. The central and tubular chambers 40 and 42 are communicated through the interior of the coupling portion 36. In the preferred embodiment, the tubular and central walls 19 and 28 are coupled for transmitting vertical deformation therebetween where the coupling portion 36 communicates the interior chambers 40 and 42. In an alternative embodiment, however, these chambers 40 and 42 may be separated internally if desired. Also, in another alternative embodiment, the hollow central and tubular walls 28 and 19 may be filled with a deformable filler material such as a foam, gel, or other material commonly employed in shoe soles.

The central and tubular walls 28 and 19 also preferably comprise stiffening ribs 44 that extend widthwise across the central and tubular portions 26 and 24. It should be appreciated that FIG. 3 omits the ribs 44 for clarity. As the walls 19 and 28 of the cushion 10 of the embodiment shown are of substantially uniform thickness, the ribs 44 form grooves 46 on an opposite side of the walls 19 and 28 therefrom. Ribs 44 increase the bending stiffness of the walls 19 and 28. The walls 19 and 28 become stiffer as the ribs 44 are spaced closer to each other, made thicker, and as they extend further from the remainder of the surface of the walls 19 and 28. The ribs 44 are preferably between about 1–4 mm wide and are spaced by between about 6–18 mm.

Although the ribs may be oriented in parallel to each other, the preferred ribs extend in an orientation generally perpendicular to the running strike path 66 shown in FIG. 4. The ribs 44 of the embodiment shown are oriented at an angle 68 of preferably less than about 40° from a line 70 normal to the strike path 66, and more preferably of less than about 20° therefrom.

As shown in FIG. 1, the bottom central wall 28 includes an indented portion 64 that has substantially the same depth as the ribs 44. Thus, the ribs 44 do not extend across this indented portion 64. In other embodiments, additional outsole material may be fixed to the indented portion 64, or the indented portion 64 may display decorative or trade insignia. FIG. 2 shows the indented portion 64 as having an elliptical shape.

The preferred cross-sectional shape of the cushion 10 taken along plane III—III of FIG. 2, which that extends widthwise and vertically through the cushion 10, is best shown in FIG. 3. Both the central and tubular walls 28 and 19 have an arcuate shape. The central wall 28 preferably defines an oval or elliptical cross-section. The preferred cross-sections of the tubular walls 19 are generally circular when compared to the cross-section of the central wall 28. Due to these shapes, the cushion 10 stores and returns energy to a wearer. The relatively wide and horizontal elevated portions 34 of the central walls 28 renders the central portion less stiff than the tubular portion 24. At the widest part of the cushion 10, which is shaped for a heel, the central portion 26 reaches a maximum width 74 that is preferably greater than about 50% of the maximum width 84 of the cushion 10 from the medial edge of the medial tubular portion 18 to the lateral edge of the lateral tubular portion 20, and more preferably about 60% as wide as the maximum width 84 of the cushion 10. Preferably, one of the medial and lateral tubular portions 18 and 20 is at least about 15% as wide as the central portion 26 where the cushion 10 is widest, and more preferably about 20% as wide.

Also, in the preferred embodiment, the central and tubular portions 26 and 24 have substantially the same vertical height 72. An aspect ratio of each cushion portion 18 and 20 is defined as the ratio of the widths 74 and 75 of the cushion portions 24 and 26 to the height 72 thereof. The aspect ratios of the tubular portions 18 and 20 are measured across their central axes. The maximum aspect ratio of the central portion 26 is between about 2 and 3, and preferably about 2.6. The aspect ratio of the tubular portion 24 is between about 0.75 and 1.5 along the lateral and medial sides of the cushion 10, and is preferably about 1.

The resulting higher stiffness of the tubular portion 24 when compared to the central portion 26 is desired as this stabilizes a foot toward the central portion 26 during impact. With the central walls 28 deforming vertically more than the tubular walls 19 during an impact, the cushion 10 directs the foot towards the central portion 26 during each stride, reducing the chance of injury.

Figure 5:
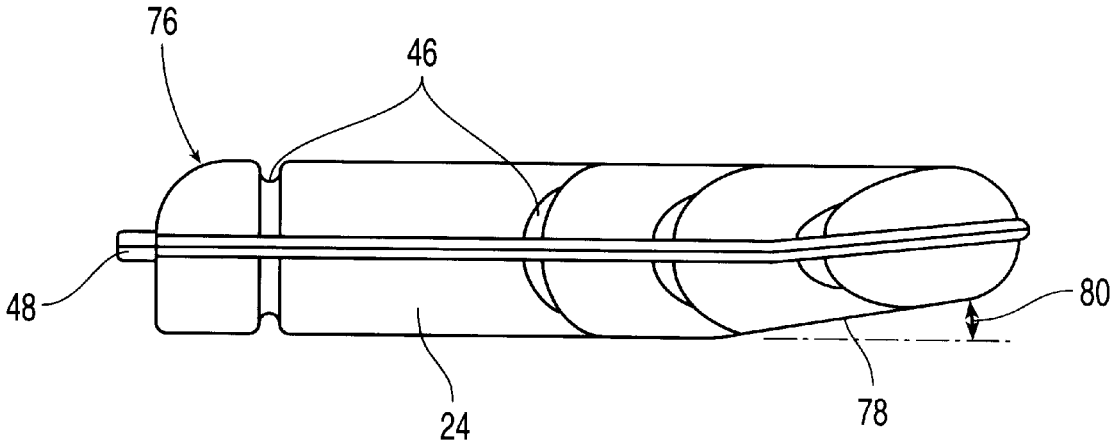
FIG. 5 is a lateral view of the cushion.

Referring to FIG. 5, the forward part of the cushion 10, including the central and tubular walls 28 and 19, has a rounded forward edge 76. Rounded edge 76 facilitates flexure of the longitudinally central part of the sole during a step. Also, the rear of the cushion 10 becomes vertically thinner as a lower rear surface 78 is angled upwardly at an angle 80 of about 10° from the horizontal. This angle 80 provides a raised heel of the outsole to improve comfort while a wearer is running.

The cushion 10 is preferably blow molded as a single piece of unitary construction. HYTREL HTR5612, a polyester elastomer designed for blow molding and sold by Dupont, is the preferred material for use in the construction of the cushion 10. Other materials very suitable for blow molding the cushion 10 have relatively high melt viscosities. The most preferred cushion material preferably has a Poisson's ratio of about 0.45, a flexural modulus of around 124 MPa, and a hardness durometer of 50 on the D scale. When subjected to a compression test in which the material is compressed to 50% of its original thickness for 48 hours and then released, the material preferably decompresses substantially completely. The preferred HYTREL material returns to within 1% of its original thickness after a compression test. The remainder of the midsole, outsole, and insole, which is mounted above the midsole for placement adjacent a foot, are made from conventional materials.

As a result of the blow molding process, a hollow stub 48 remains through which air was blown during manufacturing. This stub 48 is preferably sealed to prevent the cushion 10 from emitting an annoying noise each time a step is taken, as air is sucked in and blown out through the stub. Sealing the stub 48 also prevents water, or other fluids that may be present on a walking surface from entering the cushion 10. If the stub 48 itself is not closed, adjacent material 50 of the shoe sole may be used to close the stub opening. As mentioned above, although the cushion 10 traps air once the stub 48 is closed, the walls 19 and 28 of the cushion 10 provide the main support and cushioning for a foot, instead of the trapped air. Trapped air, if any, is preferably not significantly pressurized.

One of ordinary skill in the art can envision numerous variations and modifications. For example, alternative embodiments may have no stiffening ribs, or may be configured for use in a forefoot region, or other region, of a shoe sole. All of these modifications are contemplated by the true spirit and scope of the following claims.

What is claimed:

1. A cushion for use in a shoe sole, the cushion comprising:

first and second tubular portions having resilient load-bearing first and second hollow tubular walls, one of the walls having a shape for extending generally along a lateral side of a wearer's foot and the other having a shape for extending generally along a medial side of the wearer's foot, the tubular walls comprising a thickness, material, and shape providing sufficient strength for supporting and cushioning the lateral and medial sides; and a central portion having a resilient load-bearing hollow central wall disposed between and joined with the first and second tubular portions and comprising a thickness, material, and shape providing sufficient strength for supporting and cushioning a widthwise central part of the foot.

2. The cushion of claim 1, further comprising a coupling portion coupling the central and first walls such that vertical deformation of one of the central and first walls is transmitted to the other.

3. The cushion of claim 1, wherein the tubular and central walls are shaped for extending respectively along sides and a widthwise central portion of the heel of the a wearer's foot.

4. The cushion of claim 1, wherein the central and tubular portions have vertical heights that are substantially equal to each other.

5. The cushion of claim 1, wherein the first and second tubular portions respectively have first and second widths, and the central portion has a central width that is greater than at least one of the first and second widths.

6. The cushion of claim 1, wherein the central and tubular walls are arcuate, such that central and tubular portions have oval cross-sections along a plane that extends widthwise and vertically.

7. The cushion of claim 6, wherein:

the central portion defines a central aspect ratio of width to height that of between about 2 and 4; and the first tubular portion defines a first aspect ratio of width to height of between about 0.75 and 1.5.

8. The cushion of claim 1, wherein at least one of the tubular and central walls has ribs extending widthwise thereacross configured and dimensioned for increasing wall stiffness.

9. The cushion of claim 8, wherein the at least one of the tubular and central walls has a substantially uniform thickness and defines grooves on a side thereof opposite from the ribs and extending generally widthwise across the central portion.

10. The cushion of claim 1, wherein the central and tubular walls are of unitary construction from a single piece of molded plastic material.

11. The cushion of claim 1, wherein the thickness, material, and shape of the tubular and central walls are selected such that the tubular portions are vertically stiffer than the central portion for stabilizing the wearer's foot towards the central portion.

12. The cushion of claim 1, wherein air enclosed within the central and tubular portions is at substantially atmospheric pressure.

13. The cushion of claim 1, wherein strength of the tubular and central walls is sufficient for supporting the sides and central part of the wearer's foot irrespective of any material contained within the tubular and central walls.

14. A shoe sole comprising:

a midsole that includes the cushion of claim 1; and an outsole mounted below the midsole for contacting the ground.

15. A cushion for use in a shoe sole, the cushion comprising:

first and second tubular portions having resilient load-bearing first and second hollow tubular walls having a shape for extending generally along a lateral side of a wearer's foot and the other having a shape for extending generally along a medial side of the wearer's foot, the tubular walls comprising a thickness, material, and shape providing sufficient strength for supporting and cushioning the lateral and medial sides;

a central portion having a resilient load-beating hollow central wall disposed between and joined with the first and second tubular portions and comprising a thickness, material, and shape providing sufficient strength for supporting and cushioning a widthwise central part of the foot; and a coupling portion coupling the central wall to the first wall such that vertical deformation of one of the central and first walls is transmitted to the other.

16. The cushion of claim 15, wherein:

the central and first walls include vertically spaced elevated sections; and the coupling portion has vertically spaced coupling walls, at least one of the coupling walls joining together at least one coupled pair of walls consisting of the elevated walls that are adjacent each other such that vertical deformation is transmitted through the coupling walls between the coupled pair of walls of the central portion and first tubular portion.

17. The cushion of claim 15, further comprising a recessed portion joining the central portion and first tubular portion such that vertical deformation is substantially isolated between sections of the central portion and first tubular portion that are disposed adjacent the recessed portion.

18. The cushion of claim 15, wherein the coupling portion is is disposed with respect to the tubular and central portions along a strike path of the wearer's foot.

19. The cushion of claim 15, wherein the coupling portion is is disposed with respect to the tubular and central portions in a heel strike area of the wearer's foot.

20. The cushion of claim 19, wherein the coupling portion is offset laterally from a longitudinal centerline that extends through the wearer's heel.

21. The cushion of claim 15, wherein the coupling portion is disposed off-center widthwise with respect to the cushion.

22. A shoe sole comprising:

a midsole that includes the cushion of claim 15; and an outsole mounted below the midsole for contacting the ground.

23. A cushion for use in a shoe sole, the cushion comprising:

first and second tubular portions having resilient load-bearing first and second hollow tubular walls having a shape for extending generally along a lateral side of a wearer's heel and the other having a shape for extending generally along a medial side of the wearer's heel, the tubular walls comprising a thickness, material, and shape providing sufficient strength for supporting and cushioning the lateral and medial sides; and a central portion having a resilient load-bearing hollow central wall disposed between and joined with the first and second tubular portions and comprising a thickness, material, and shape providing sufficient strength for supporting and cushioning a widthwise central part of the heel.

24. The cushion of claim 23, wherein one of the tubular portions extends along a rear edge of the wearer's heel for supporting a rear edge of the wearer's heel.

25. The cushion of claim 24, wherein the tubular portions are joined at a rear section of the wearer's heel such that the first and second tubular portions together form a single tubular portion that extends substantially along an outer contour of the wearer's heel.

26. The cushion of claim 23, wherein the central portion is joined to the tubular portions at a rear part of the central portion.

27. The cushion of claim 23, wherein the central and tubular walls define a lower surface that slopes upwards from the horizontal at a rear section beneath the wearer's heel.

28. A shoe sole comprising:

a midsole that includes the cushion of claim 23; and an outsole mounted below the midsole for contacting the ground.

* * * * *